US007169741B2

(12) United States Patent
Barry et al.

(10) Patent No.: US 7,169,741 B2
(45) **Date of Patent: *Jan. 30, 2007**

(54) AQUEOUS LIQUID LAUNDRY DETERGENT COMPOSITIONS WITH VISIBLE BEADS

(75) Inventors: Susan Mary Barry, Brussels (BE); Walter August Maria Broeckx, Holywell (GB); James Charles Theophile Roger Burckett St. Laurent, Brussels (BE); Mark Allen Smerznak, Whitley Bay (GB)

(73) Assignee: The Procter & Gamble Company, Cincinnati, OH (US)

( * ) Notice: Subject to any disclaimer, the term of this patent is extended or adjusted under 35 U.S.C. 154(b) by 207 days.

This patent is subject to a terminal disclaimer.

(21) Appl. No.: 10/903,223

(22) Filed: Jul. 30, 2004

(65) Prior Publication Data

US 2005/0043200 A1 Feb. 24, 2005

(30) Foreign Application Priority Data

Aug. 1, 2003 (EP) ..... 03447205

(51) Int. Cl.

| | |
|---|---|
| ***C11D 1/00*** | (2006.01) |
| ***C11D 1/83*** | (2006.01) |
| ***C11D 3/12*** | (2006.01) |
| ***C11D 3/37*** | (2006.01) |
| ***C11D 17/00*** | (2006.01) |

(52) U.S. Cl. ..... 510/337; 510/340; 510/349; 510/418; 510/434; 510/438; 510/441; 510/462; 510/470

(58) Field of Classification Search ..... 510/337, 510/340, 349, 418, 434, 438, 441, 462, 470
See application file for complete search history.

(56) References Cited

U.S. PATENT DOCUMENTS

| | | | | |
|---|---|---|---|---|
| 6,258,771 | B1 * | 7/2001 | Hsu et al. | 510/418 |
| 6,369,018 | B1 | 4/2002 | Hsu et al. | |
| 6,534,091 | B1 | 3/2003 | Garces et al. | |
| 6,855,680 | B2 * | 2/2005 | Smerznak et al. | 510/321 |

FOREIGN PATENT DOCUMENTS

| | | |
|---|---|---|
| CA | 2306376 | * 10/2000 |
| DE | 10100681 | 1/2001 |
| EP | WO 2005/012475 | * 2/2005 |

* cited by examiner

*Primary Examiner*—Brian Mruk
(74) *Attorney, Agent, or Firm*—Armina E. Matthews; Kim William Zerby

(57) ABSTRACT

Disclosed are aqueous liquid laundry detergent compositions which are in the form of an externally structured aqueous liquid matrix having dispersed therein a plurality of visibly distinct beads. Such beads are prepared so as to be in the form of a liquid core surrounded by a semi-permeable membrane formed by interaction of a cationic polymeric material with an anionic polymeric material. Such beads are stable in the aqueous liquid detergent compositions herein yet disintegrate substantially upon their introduction via the composition into agitated dilute aqueous laundering liquors.

20 Claims, No Drawings

AQUEOUS LIQUID LAUNDRY DETERGENT COMPOSITIONS WITH VISIBLE BEADS

CROSS REFERENCE TO RELATED APPLICATIONS

This application claims priority under 35 U.S.C. § 119(a) to European Application Serial No. 03447205.0, filed Aug. 1, 2003.

FIELD OF THE INVENTION

This invention relates to liquid laundry detergent products which are aqueous in nature and which are in the form of suspensions of visibly distinct beads in an externally structured liquid matrix.

BACKGROUND OF THE INVENTION

The commercial marketing of laundry detergent products often involves the use of distinctive product aesthetics to help differentiate one given product from other commercially available products of the same general type. Colored, e.g., dyed or pigmented, particles such as speckles or beads are sometimes used to create such distinctiveness. Generally, distinct particles in detergent products should be larger than 200 microns to be easily visible to the consumer (although in certain circumstances much smaller particles may also be visible).

The presence of visibly distinct particles such as beads in detergent products can provide a signal to the consumer that the product has been changed and improved from previously marketed or available products without such beads. Thus, such a signal can serve to indicate that altered, new and/or additional fabric cleaning and/or fabric treatment ingredients have been added to the product or that the product contains ingredients which alter the overall laundering experience of using the product. Such new or additional ingredients may actually be incorporated into the visible beads themselves or may simply be incorporated into the bulk matrix of the product with their presence signaled by the beads. If new and/or additional detergent composition components are incorporated into the visibly distinct beads, such beads may then serve the additional purpose of helping to stabilize or protect such incorporated detergent product ingredients from interaction with or degradation by other components of the composition.

In a granular detergent context, suspension of visible particles in the product is fairly straightforward. This is because the formulator is free to chose visibly distinct, e.g., dyed or pigmented, particles which can be matched in density and particle size to the bulk granular detergent. Such particles are easily dispersed throughout the granular matrix, and there is little likelihood of destructive interaction beween the visible particles and the other matrix ingredients.

In a liquid detergent context, however, and especially with respect to aqueous liquid laundry detergents, it is a challenge to stably suspend particles and to have such particles not become problematic when the detergent product is made, shipped, stored and/or used. The formulator must use beads which are both relatively insoluble in the aqueous liquid detergent matrix and are strong enough to withstand the rigors of commercial scale detergent composition preparation, shipping and distribution. Yet these same beads must also suitably dissolve or disintegrate when the detergent product is used to form a laundry washing solution or liquor. Suitable dissolution or disintegration, of course, means that the beads must dissolve or disintegrate within the wash liquor to the extent that the beads or remants thereof do not leave visible residues on fabrics being laundered.

Preferred suspension of the beads also requires suitable formulation of the aqueous liquid matrix of the detergent product. To stably suspend beads, liquid compositions should ideally be "structured" so that the liquid portion thereof has suitable Theological characteristics. Thus the matrix rheology must be such that it is sufficiently viscous that the beads do not settle out of the product upon prolonged storage yet not so viscous that the product cannot be readily poured. Thus also ideally any "structurant" material which is added to the composition would be one which imparts "shear-thinning" characteristics to the matrix without creating any aesthetic or other difficulties such as opacity, instability or unacceptable expense.

Finally preferred utilization of the suspended beads to carry and protect detergent composition ingredients requires selection of particular types of bead materials and carried components. If beads are used for this preferred purpose, the beads must be constructed so as to partially or completely isolate the carried materials from any other components in the composition which might be incompatible with such carried ingredients. Yet the beads must also be able to suitably release their carried ingredient into the wash liquor when the composition is used to launder fabrics.

Given the foregoing, there is a continuing need to identify materials, component combinations and procedures which can be used to suitably impart desirable aesthetic and performance characteristics to aqueous liquid detergent products by means of incorporating visibly distinct beads thereinto. Accordingly, it is a primary object of the present invention to formulate aqueous liquid laundry detergent compositions having aesthetics-altering, visibly distinct beads therein.

It is a further object of the present invention to stably suspend such visibly distinct beads within preferred liquid detergent products.

It is a further object of the present invention to provide beads which impart desirable aesthetics to concentrated aqueous liquid detergent products but which do not leave visible residues on fabrics or otherwise interfere with the laundering operations that use such products.

It is a further object of the present invention to provide preferred aqueous liquid detergent compositions which utilize visibly distinct beads suspended therein to carry, protect and release into the wash liquor one or more active laundry detergent composition adjuncts.

It has now been found that there are selected combinations of means and materials suitable for preparation of beads and the liquid detergent compositions into which such beads are added in order to achieve the forgoing objectives with respect to formulation of the bead-containing liquid detergent products herein.

SUMMARY OF THE INVENTION

The present invention provides heavy duty liquid detergent compositions in the form of an externally-structured, aqueous liquid matrix having dispersed therein a plurality of visibly distinct beads. Such compositions comprise: A) from 5% to 50% by weight of a detersive surfactant; B) from 0.1% to 30% by weight of a selected type of laundry washing adjunct; C) from 0.01% to 1% by weight of a certain kind of organic external structurant; D) from 0.01% to 5% by weight of a certain selected type of visibly distinct beads; and E) from 30% to 75% by weight of water.

The essential detersive surfactant is selected from anionic surfactants, nonionic surfactants and combinations thereof. The laundry washing adjunct is selected from detersive enzymes, optical brighteners, dye transfer inhibition agents, suds suppressors, detersive soil release polymers, other fabric care benefit agents, and combinations of such laundry washing adjuncts.

The organic external structurant is selected from non-polymeric crystalline, hydroxy-functional materials; polymeric structurants which impart shear thinning characteristics to the aqueous liquid matrix of the composition; any other structurant which imparts to the aqueous liquid matrix of the composition a pouring viscosity at 20 $sec^{-1}$ of from 100 to 2500 cps; a viscosity at constant low stress of 0.1 Pa which is at least 1500 cps, and a ratio of the constant stress viscosity value to the pouring viscosity value of at least 2; and combinations of such external structurant types. The crystalline, hydroxy-functional materials are those which form thread-like structuring systems throughout the matrix of the composition upon in situ crystallization in the matrix. The polymeric structurants are selected from polyacrylates, polymeric gums, other non-gum polysaccharides, and combinations of these polymeric materials.

The visibly distinct beads dispersed within the aqueous liquid matrix each comprise a liquid core solution containing a cationic or anionic polymeric component and a semipermeable membrane formed by interaction of the cationic or anionic polymeric bead core component with an anionic or cationic component of opposite charge. The semipermeable membrane in each bead serves to impart osmotic permeability characteristics to the bead such that the beads maintain their structural integrity within the aqueous liquid matrix of the detergent composition but also such that the beads disintegrate without leaving visible residues as a consequence of osmotic water permeability into the beads upon aqueous dilution of the detergent composition during washing operations.

DETAILED DESCRIPTION OF THE INVENTION

The essential and optional components of the aqueous liquid detergent compositions herein, as well as composition form, preparation and use, are described in greater detail as follows: (All concentrations and ratios are on a weight basis unless otherwise specified. All documents cited herein are, in relevant part, incorporated herein by reference. The citation of any document is not to be considered as an admission that it is prior art with respect to the present invention.)

Detersive Surfactant

The liquid detergent compositions herein will essentially contain from 5% to 50% by weight, preferably from 8% to 40% by weight, more preferably from 10% to 35% by weight, of a certain kind of detersive surfactant component. Such an essential detersive surfactant component must comprise anionic surfactants, nonionic surfactants, or combinations of these two surfactant types.

Suitable anionic surfactants useful herein can comprise any of the conventional anionic surfactant types typically used in liquid detergent products. These include the alkyl benzene sulfonic acids and their salts as well as alkoxylated or un-alkoxylated alkyl sulfate materials.

Preferred anionic surfactants are the alkali metal salts of $C_{10-16}$ alkyl benzene sulfonic acids, preferably $C_{11-14}$ alkyl benzene sulfonic acids. Preferably the alkyl group is linear and such linear alkyl benzene sulfonates are known as "LAS". Alkyl benzene sulfonates, and particularly LAS, are well known in the art. Such surfactants and their preparation are described for example in U.S. Pat. Nos. 2,220,099 and 2,477,383. Especially preferred are the sodium and potassium linear straight chain alkylbenzene sulfonates in which the average number of carbon atoms in the alkyl group is from about 11 to 14. Sodium $C_{11}$–$C_{14}$, e.g., $C_{12}$, LAS is especially preferred.

Another preferred type of anionic surfactant comprises ethoxylated alkyl sulfate surfactants. Such materials, also known as alkyl ether sulfates or alkyl polyethoxylate sulfates, are those which correspond to the formula:

$$R'—O—(C_2H_4O)_n—SO_3M$$

wherein R' is a $C_8$–$C_{20}$ alkyl group, n is from about 1 to 20, and M is a salt-forming cation. Preferably, R' is $C_{10}$–$C_{18}$ alkyl, n is from about 1 to 15, and M is sodium, potassium, ammonium, alkylammonium, or alkanolammonium. Most preferably, R' is a $C_{12}$–$C_{16}$, n is from about 1 to 6 and M is sodium.

The alkyl ether sulfates will generally be used in the form of mixtures comprising varying R' chain lengths and varying degrees of ethoxylation. Frequently such mixtures will inevitably also contain some unethoxylated alkyl sulfate materials, i.e., surfactants of the above ethoxylated alkyl sulfate formula wherein n=0. Unethoxylated alkyl sulfates may also be added separately to the compositions of this invention and used as or in any anionic surfactant component which may be present.

Preferred unalkoyxylated, e.g., unethoxylated, alkyl ether sulfate surfactants are those produced by the sulfation of higher $C_8$–$C_{20}$ fatty alcohols. Conventional primary alkyl sulfate surfactants have the general formula:

$$ROSO_3^-M^+$$

wherein R is typically a linear $C_8$–$C_{20}$ hydrocarbyl group, which may be straight chain or branched chain, and M is a water-solubilizing cation. Preferably R is a $C_{10}$–$C_{15}$ alkyl, and M is alkali metal. Most preferably R is $C_{12}$–$C_{14}$ and M is sodium.

Suitable nonionic surfactants useful herein can comprise any of the conventional nonionic surfactant types typically used in liquid detergent products. These include alkoxylated fatty alcohols, ethylene oxide (EO)-propylene oxide (PO) block polymers, and amine oxide surfactants. Preferred for use in the liquid detergent products herein are those nonionic surfactants which are normally liquid.

Preferred nonionic surfactants for use herein include the alcohol alkoxylate nonionic surfactants. Alcohol alkoxylates are materials which correspond to the general formula:

$$R^1(C_mH_{2m}O)_nOH$$

wherein $R^1$ is a $C_8$–$C_{16}$ alkyl group, m is from 2 to 4, and n ranges from about 2 to 12. Preferably $R^1$ is an alkyl group, which may be primary or secondary, that contains from about 9 to 15 carbon atoms, more preferably from about 10 to 14 carbon atoms. Preferably also the alkoxylated fatty alcohols will be ethoxylated materials that contain from about 2 to 12 ethylene oxide moieties per molecule, more preferably from about 3 to 10 ethylene oxide moieties per molecule.

The alkoxylated fatty alcohol materials useful in the liquid detergent compositions herein will frequently have a hydrophilic-lipophilic balance (HLB) which ranges from about 3 to 17. More preferably, the HLB of this material will range from about 6 to 15, most preferably from about 8 to 15. Alkoxylated fatty alcohol nonionic surfactants have been marketed under the tradenames Neodol and Dobanol by the Shell Chemical Company.

Another type of nonionic surfactant which is liquid and which may be utilized in the compositions of this invention comprises the ethylene oxide (EO)—propylene oxide (PO) block polymers. Materials of this type are well known nonionic surfactants which have been marketed under the tradename Pluronic. These materials are formed by adding blocks of ethylene oxide moieties to the ends of polypropylene glycol chains to adjust the surface active properties of the resulting block polymers. EO-PO block polymer nonionics of this type are described in greater detail in Davidsohn and Milwidsky; *Synthetic Detergents*, 7*th Ed.*; Longman Scientific and Technical (1987) at pp. 34–36 and pp. 189–191 and in U.S. Pat. Nos. 2,674,619 and 2,677,700.

Yet another suitable type of nonionic surfactant useful herein comprises the amine oxide surfactants. Amine oxides are mateials which are often referred to in the art as "semi-polar" nonionics. Amine oxides have the formula: $R(EO)_x(PO)_y(BO)_zN(O)(CH_2R')_2.qH_2O$. In this formula, R is a relatively long-chain hydrocarbyl moiety which can be saturated or unsaturated, linear or branched, and can contain from 8 to 20, preferably from 10 to 16 carbon atoms, and is more preferably $C_{12}$–$C_{16}$ primary alkyl. R' is a short-chain moiety preferably selected from hydrogen, methyl and —$CH_2OH$. When x+y+z is different from 0, EO is ethyleneoxy, PO is propyleneneoxy and BO is butyleneoxy. Amine oxide surfactants are illustrated by $C_{12-14}$ alkyldimethyl amine oxide.

In the liquid detergent compostions herein, the essential detersive surfactant component may comprise combinations of anionic and nonionic surfactant materials. When this is the case, the weight ratio of anionic to nonionic will typically range from 100:1 to 1:100, more typically from 20:1 to 1:20.

The detersive surfactant materials used in the compositions herein may provide an "internal" structuring effect to the aqueous liquid matrix over and above the matrix rheology-modifying contribution provided by the essential "external" structurant component as defined and described in detail hereinafter. However, the surfactants used herein will not provide an "internal" structuring effect which, in and of itself, would be sufficient to achieve the desired rheological characteristics of the liquid matrix of the aqueous liquid compositions of this invention.

Laundry Washing Adjunct

The liquid detergent compositions herein will also essentially contain from 0.1% to 30% by weight, preferably from 0.5% to 20% by weight, more preferably from 1% to 10% by weight, of one or more of certain kinds of laundry washing adjuncts. Such essentially present laundry washing adjuncts can be selected from detersive enzymes, optical brighteners, dye transfer inhibition agents, suds suppressors, detersive soil release polymers, other fabric care benefit agents, and combinations of these adjunct types. All of these materials are of the type conventionally utilized in laundry detergent products. They can, however, be delivered to aqueous washing liquors, and/or to fabrics being laundered therein, especially effectively via the compositions of the present invention.

Detersive Enzymes

The laundry washing adjunct component of the compositions herein may comprise one or more detersive enzymes which provide cleaning performance and/or fabric care benefits. Examples of suitable enzymes include, but are not limited to, hemicellulases, peroxidases, proteases, cellulases, xylanases, lipases, phospholipases, esterases, cutinases, pectinases, keratanases, reductases, oxidases, phenoloxidases, lipoxygenases, ligninases, pullulanases, tannases, mannanases?, pentosanases, malanases, β-glucanases, arabinosidases, hyaluronidase, chondroitinase, laccase, and known amylases, or combinations thereof. A preferred enzyme combination comprises a cocktail of conventional detersive enzymes like protease, lipase, cutinase and/or cellulase in conjunction with amylase. Detersive enzymes are described in greater detail in U.S. Pat. No. 6,579,839.

If employed, enzymes will normally be incorporated into the liquid laundry detergent compositions herein at levels sufficient to provide up to 10 mg by weight, more typically from about 0.01 mg to about 5 mg, of active enzyme per gram of the composition. Stated otherwise, the aqueous liquid detergent compositions herein can typically comprise from 0.001% to 5%, preferably from 0.01% to 1% by weight, of a commercial enzyme preparation. Protease enzymes, for example, are usually present in such commercial preparations at levels sufficient to provide from 0.005 to 0.1 Anson units (AU) of activity per gram of detergent composition.

Optical Brighteners

The laundry washing adjunct component of the compositions herein may comprise one or more optical brighteners which provide fabric treatment benefits. Such materials, also known as fluorescent whiting agents (FWAs), are generally deposited onto fabrics or garments being laundered and alter the optical or chromaticity characteristics of the substrates so treated.

Preferred optical brighteners are anionic in character. Many are stilbene derivatives. Examples of such materials include are disodium 4,4'-bis-(2-diethanolamino-4-anilino-s-triazin-6-ylamino)stilbene-2:2' disulphonate, disodium 4,-4'-bis-(2-morpholino-4-anilino-s-triazin-6-ylamino-stilbene-2:2'-disulphonate, disodium 4,4'-bis-(2,4-dianilino-s-triazin-6-ylamino)stilbene-2:2'-disulphonate, monosodium 4',4"-bis-(2,4-dianilino-s-tri-azin-6ylamino)stilbene-2-sulphonate, disodium 4,4'-bis-(2-anilino-4-(N-methyl-N-2-hydroxyethylamino)-s-triazin-6-ylamino)stilbene-2,2'-disulphonate, di-sodium 4,4'-bis-(4-phenyl-2,1,3-triazol-2-yl)-stilbene-2,2'disulphonate, di-so-dium 4,4'bis(2-anilino-4-(1-methyl-2-hydroxyethylamino)-s-triazin-6-ylami-no) stilbene-2,2'disulphonate, sodium 2(stilbyl-4"-(naphtho-1', 2':4,5)-1,2,3-triazole-2"-sulphonate and 4,4'-bis(2-sulphostyryl)biphenyl.

Brighteners have been marketed under the tradeneames Tinopal™ and Brightener No. (#)™ by Ciba-Geigy. They are described in greater detail in European Patent Application EP-A-753 567 and U.S. Pat. No. 5,174,927.

If employed, optical brighteners will typically be incorporated into the liquid laundry detergent compositions herein in concentrations ranging from 0.01% to 1%, preferably from 0.05% to 0.5%, by weight.

Dye Transfer Inhibition Agents

The laundry washing adjunct component of the compositions herein may comprise one or more dye transfer inhibition agents which permit desirable laundering of colored fabrics. Suitable polymeric dye transfer inhibiting agents include, but are not limited to, polyvinylpyrrolidone polymers, polyamine N-oxide polymers, copolymers of N-vinylpyrrolidone and N-vinylimidazole, polyvinyloxazolidones and polyvinylimidazoles or mixtures thereof.

Suitable dye transfer inhibition agents are described in greater detail in U.S. Pat. Nos. 5,783,548; 5,604,194; and 5,466,802.

If employed, dye transfer inhibiting agents will typically be incorporated into the liquid laundry detergent compositions herein in concentrations ranging from 0.0001%, more preferably from 0.01%, most preferably from 0.03% by weight to 10%, more preferably to 2%, most preferably to 1% by weight.

Suds Suppressors

The laundry washing adjunct component of the compositions herein may comprise one or more materials which act as suds suppressors to minimize over-sudsing of the compositions herein when they are employed for laundering of fabrics in automatic washing machines. Frequently, suds suppressor systems are based on silicones or silica-silicone combinations. Examples of suitable suds suppressors for use herein are disclosed in U.S. Pat. Nos. 5,707,950 and 5,728,671. A preferred suds suppressor is a polydimethylsiloxane compounded with silica.

If employed, suds suppressors will typically be incorporated into the liquid laundry detergent compositions herein in concentrations ranging from 0.001% to 2% by weight. More preferably, suds suppressors can comprise from 0.01% to 1% by weight of the compositions herein.

Detersive Soil Release Polymers

The laundry washing adjunct component of the compositions herein may comprise one or more detersive soil release polymers which provide fabric treatment benefits. Polymeric soil release agents useful in the present invention include copolymeric blocks of terephthalate and polyethylene oxide or polypropylene oxide, and the like.

A preferred soil release agent is a copolymer having blocks of terephthalate and polyethylene oxide. More specifically, these polymers are comprised of repeating units of ethylene and/or propylene terephthalate and polyethylene oxide terephthalate at a molar ratio of ethylene terephthalate units to polyethylene oxide terephthalate units of from about 25:75 to about 35:65. This polyethylene oxide terephthalate contains polyethylene oxide blocks having molecular weights of from about 300 to about 2000. The molecular weight of this polymeric soil release agent is in the range of from about 5,000 to about 55,000.

Suitable soil release polymers are described in greater detail in U. S. Pat. Nos. 5,574,179; 4,956,447; 4,861,512; and 4,702,857. If employed, soil release polymers will typically be incorporated into the liquid laundry detergent compositions herein in concentrations ranging from 0.01% to 10%, more preferably from 0.1% to 5%, by weight of the composition.

Other Fabric Care Benefit Agents

In addition to the optical brighteners and soil release polymers hereinbefore described, the laundry washing adjunct component of the compositions herein may also comprise additional fabric care or benefit agents which can be deposited onto fabrics being laundered and which thereupon provide one or more types of fabric care or treatment benefits. Such benefits can include, for example, fabric softness, anti-static effects, ease-of-ironing benefits, anti-abrasion benefits, anti-pilling effects, color protection, wrinkle removal or improved resistance to wrinkling, fabric substantive perfume or odor benefits, malodor protection benefits, and the like.

A wide variety of materials which are suitable for providing such benefits and which can be deposited onto fabrics being laundered are known in the art. Such materials can include, for example, clays; starches; polyamines; un-functionalized and functionalized silicones such as aminosilicones and quaternary nitrogen-containing cationic silicones; cellulosic polymers, and the like. Materials of these types are described in greater detail in one or more of the following publications: U.S. Pat. Nos. 6,525,013; 4,178,254; WO 02/40627; WO 02/18528; WO 00/71897; WO 00/71806; WO 98/39401; and WO 98/29528.

If employed, such additional fabric care benefit agents polymers can typically be incorporated into the liquid laundry detergent compositions herein in concentrations ranging from 0.05% to 20%, by weight, depending upon the nature of the materials to be deposited and the benefit(s) they are to provide. More preferably, such fabric care benefit agents can comprise from 0.1% to 10%, by weight of the composition.

Organic External Structurant

Another essential component of the liquid laundry detergent compositions herein is an organic external structurant. The overall objective in adding such a structurant to the compositions herein is to arrive at liquid compositions which are suitably functional and aesthetically pleasing from the standpoint of product thickness, product pourability, product optical properties, and/or bead suspension performance. Thus the structurant will generally serve to establish appropriate rheological characteristics of the liquid product and will do so without imparting any undesirable attributes to the product such as unacceptable optical properties or unwanted phase separation. Generally the organic external structurant will comprise from 0.01% to 1% by weight, preferably from 0.015% to 0.75% by weight, more preferably from 0.02% to 0.5% by weight, of the compositions herein.

The structurant component of the compositions herein is characterized as an "external" structurant. An "external" structurant, for purposes of this invention, is a material which has as its primary function that of providing rheological alteration of the liquid matrix. Generally, therefore, an external structurant will not, in and of itself, provide any significant fabric cleaning or fabric care benefit or any significant ingredient solubilization benefit. An external structurant is thus distinct from an "internal" structurant which may also alter matrix rheology but which has been incorporated into the liquid product for some additional primary purpose. Thus, for example, an internal structurant would be anionic surfactants which can serve to alter Theological properties of liquid detergents, but which have been added to the product primarily to act as the cleaning ingredient.

The external structurant of the compositions of the present invention is used to provide an aqueous liquid matrix for the composition which has certain rheological characteristics. The principal one of these characteristics is that the matrix must be "shear-thinning". A shear-thinning fluid is one with a viscosity which decreases as shear is applied to the fluid. Thus, at rest, i.e., during storage or shipping of the liquid detergent product, the liquid matrix of the composition should have a relatively high viscosity. When shear is applied to the composition, however, such as in the act of pouring or squeezing the composition from its container, the viscosity of the matrix should be lowered to the extent that dispensing of the fluid product is easily and readily accomplished.

The at-rest viscosity of the compositions herein will ideally be high enough to accomplish several purposes. Chief among these purposes is that the composition at rest should be sufficiently viscous to suitably suspend the visible beads which are another essential component of the invention herein. A secondary benefit of a relatively high at-rest viscosity is an aesthetic one of giving the composition the appearance of a thick, strong, effective product as opposed to a thin, weak, watery one. Finally, the requisite rheological characteristics of the liquid matrix should be provided via an external structurant which does not disdvantageously detract from the visibility of the beads suspended within the composition, i.e., by making the matrix opaque to the extent that the suspended beads are obscured.

The ideal rheological characteristics of the liquid matrix, as provided by the external structurant herein in combination with all of the other ingredients of the matrix, can be quantified by specifying a pouring viscosity, a viscosity under a specified constant low stress, and a ratio of these two viscosity values. Both viscosity parameters can be measured for the compositions herein by using a Carrimed CLS 100 Viscometer with a 40 mm stainless steel parallel plate having a gap of 500 microns. All viscosity measurements are taken at 20° C. Such measurements are made on the aqueous liquid detergent matrix without the beads.

The pouring viscosity of the liquid matrix of the compositions herein should be measured at a shear rate of 20 $sec^{-1}$. Suitable structurants are those which provide liquid detergent matrix having a pouring viscosity which generally ranges from 100 to 2500 cps, more preferably from 100 to 1500 cps.

The aqueous liquid matrix of the compositions herein will generally also have specified viscosity characteristics measured under a selected constant low stress value. The constant low stress value which is selected for purposes of this invention is 0.1 Pa. That value represents the stress which is applied to the liquid detergent matrix by a typical bead of the type employed in the compositions herein.

The viscosity of the aqueous liquid matrix under a constant low stress of 0.1 Pa can be determined using the same Carrimed Viscometer in a creep experiment over a 5 minute interval, again conducted at 20° C. Rheology measurements over the 5 minute interval are made after the rheology of the matrix has recovered completely from any past high-shear events and has rested at zero shear rate for 10 minutes between loading the sample in the viscometer and running the test. The data over the last 3 minutes are used to fit a straight line, and from the slope of this line viscosity is calculated. Using this procedure, the viscosity of the matrix determined at the constant low stress of 0.1 Pa will generally be at least 1,500 cps, preferably at least 10,000 cps, and most preferably even at least 50,000 cps. Finally, to exhibit suitable shear-thinning characteristics for purposes of this invention, the aqueous liquid matrix of the compositions herein should generally have a ratio of its 0.1 Pa constant low stress viscosity value, as determined above, to its pouring viscosity value, also as determined above, which is at least 2. More preferably, this ratio of constant low stress viscosity to pouring viscosity will be at least 10. Most preferably this viscosity ratio is significantly higher than either of these values and is at least 100.

Materials which form shear-thinning fluids when combined with water or other aqueous liquids are generally known in the art. Such materials can be selected for use in the compositions herein provided they can be used to form an aqueous liquid matrix having the Theological characteristics set forth hereinbefore.

One type of structuring agent which is especially useful in the compositions of the present invention comprises nonpolymeric (except for conventional alkoxylation), crystalline hydroxy-functional materials which can form thread-like structuring systems throughout the liquid matrix when they are crystallized within the matrix in situ. Such materials can be generally characterized as crystalline, hydroxyl-containing fatty acids, fatty esters or fatty waxes. Such materials will generally be selected from those having the following formulas:

I)

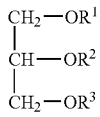

wherein:

$R^1$ is 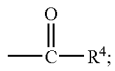 ;

$R^2$ is $R^1$ or H;

$R^3$ is $R^1$ or H;

$R^4$ is independently $C_{10}$–$C_{22}$ alkyl or alkenyl comprising at least one hydroxyl group;

II)

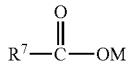

wherein:

$R^7$ is 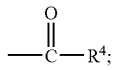 ;

$R^4$ is as defined above in i);

M is $Na^+$, $K^+$, $Mg^{++}$ or $Al^{3+}$, or H; and

III) Z-(CH(OH))a-Z' where a is from 2 to 4, preferably 2; Z and Z' are hydrophobic groups, especially selected from $C_6$–$C_{20}$ alkyl or cycloalkyl, $C_6$–$C_{24}$ alkaryl or aralkyl, $C_6$–$C_{20}$ aryl or mixtures thereof. Optionally Z can contain one or more nonpolar oxygen atoms as in ethers or esters.

Materials of the Formula I type are preferred. They can be more particularly defined by the following formula:

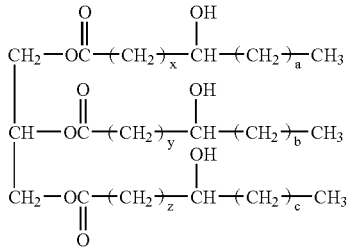

wherein:

(x+a) is from between 11 and 17;

(y+b) is from between 11 and 17; and (z+c) is from between 11 and 17.

Preferably, in this formula x=y=z=10 and/or a=b=c=5.

Specific examples of preferred crystalline, hydroxyl-containing structurants include castor oil and its derivatives. Especially preferred are hydrogenated castor oil derivatives such as hydrogenated castor oil and hydrogenated castor wax. Commercially available, castor oil-based, crystalline, hydroxyl-containing structurants include THIXCIN® from Rheox, Inc. (now Elementis).

Alternative commercially available materials that are suitable for use as crystalline, hydroxyl-containing structurants are those of Formula III hereinbefore. An example of a structurant of this type is 1,4-di-O-benzyl-D-Threitol in the R,R, and S,S forms and any mixtures, optically active or not.

All of these crystalline, hydroxyl-containing structurants as hereinbefore described are believed to function by forming thread-like structuring systems when they are crystallized in situ within the aqueous liquid matrix of the compositions herein or within a pre-mix which is used to form such an aqueous liquid matrix. Such crystallization is brought about by heating an aqueous mixture of these materials to a temperature above the melting point of the structurant, followed by cooling of the mixture to room temperature while maintaining the liquid under agitation.

Under certain conditions, the crystalline, hydroxyl-containing structurants will, upon cooling, form the thread-like structuring system within the aqueous liquid matrix. This thread-like system can comprise a fibrous or entangled thread-like network. Non-fibrous particles in the form of "rosettas" may also be formed. The particles in this network can have an aspect ratio of from 1.5:1 to 200:1, more preferably from 10:1 to 200:1. Such fibers and non-fibrous particles can have a minor dimension which ranges from 1 micron to 100 microns, more preferably from 5 microns to 15 microns.

These crystalline, hydroxyl-containing materials are especially preferred structurants for providing the detergent compositions herein with shear-thinning rheology. They can effectively be used for this purpose at concentrations which are low enough that the compositions are not rendered so undesirably opaque that bead visibility is restricted. These materials and the networks they form also serve to stabilize the compositions herein against liquid-liquid or solid-liquid (except, of course, for the beads and the structuring system particles) phase separation. Their use thus permits the formulator to use less of relatively expensive non-aqueous solvents or phase stabilizers which might otherwise have to be used in higher concentrations to minimize undesirable phase separation. These preferred crystalline, hydroxyl-containing structurants, and their incorporation into aqueous shear-thinning matrices, are described in greater detail in U.S. Pat. No. 6,080,708 and in PCT Publication No. WO 02/40627.

Other types of organic external structurants, besides the non-polymeric, crystalline, hydroxyl-containing structurants described hereinbefore, may be utilized in the liquid detergent compositions herein. Polymeric materials which will provide shear-thinning characteristics to the aqueous liquid matrix may also be employed.

Suitable polymeric structurants include those of the polyacrylate, polysaccharide or polysaccharide derivative type. Polysaccharide derivatives typically used as structurants comprise polymeric gum materials. Such gums include pectine, alginate, arabinogalactan (gum Arabic), carrageenan, gellan gum, xanthan gum and guar gum.

If polymeric structurants are employed herein, a preferred material of this type is gellan gum. Gellan gum is a heteropolysaccharide prepared by fermentation of Pseudomonaselodea ATCC 31461. Gellan gum is commercially marketed by CP Kelco U.S., Inc. under the KELCOGEL tradeneme. Processes for preparing gellan gum are described in U.S. Pat. Nos. 4,326,052; 4,326,053; 4,377,636 and 4,385,123.

Of course, any other structurants besides the foregoing specifically described materials can be employed in the aqueous liquid detergent compositions herein, provided such other structurant materials produce compositions having the selected Theological characteristics hereinbefore described. Also combinations of various structurants and structurant types may be utilized, again so long as the resulting aqueous matrix of the composition possesses the hereinbefore specified pour viscosity, constant stress viscosity and viscosity ratio values.

Visibly Distinct Beads

As another essential component, the liquid detergent compositions herein will contain from 0.01% to 5% by weight, preferably from 0.05% to 4% by weight, more preferably from 0.1% to 3% by weight, of a plurality of a certain type of visibly distinct beads. For purposes of this invention, the term"visibly distinct" has its usual and conventional meaning which is that the beads, within the detergent compositions herein, must be readily apparent and discernible to an observer inspecting the composition.

Bead visibility is, of course, determined by a number of interrelated factors including size of the beads and the various optical properties of the beads and of the liquid composition they are dispersed within. A transparent or translucent liquid matrix in combination with opaque or translucent beads will generally render the beads visible if they have a minor dimension of 0.2 mm or greater, but much smaller beads may also be visible under certain circumstances. Even transparent beads in a transparent liquid matrix might be visibly distinct if the refractive properties of beads and liquid are sufficiently different. Furthermore, even beads dispersed in a somewhat opaque liquid matrix might be visibly distinct if they are big enough and are different in color from the matrix.

The beads used in the detergent compositions of this invention must be strong enough and stable enough to withstand being introduced into and processed within commercially prepared liquid detergent products. The beads must also be physically and chemically stable within the liquid detergent compositions for prolonged periods of storage and shipping. However, when the bead-containing liquid detergent product is used to form dilute aqueous washing liquors during the process of conventional laundering operations, these same beads and their contents must be able to dissolve or disintegrate in a manner and to the extent that the beads, or visible residues therefrom, are not deposited onto fabrics being laundered in such dilute aqueous washing liquors.

It has been found that beads of a certain type are especially suitable for incorporation into the specific externally structured liquid detergent products of this invention. This is because, in such products, the beads described herein function especially well in terms of stability within the detergent composition prior to use, yet are suitably unstable in the washing liquors formed from such products. This selected type of bead comprises ones which are in the form of a liquid core comprising an ionically charged polymeric material and a surrounding semipermeable membrane. This membrane is one which can be formed by interaction of some of the ionically charged polymer in the core with another polymeric material of opposite charge.

The liquid core of the beads useful herein, in addition to containing an ionically charged polymeric material, may also comprise water, solvents and a wide variety of other materials such as laundering adjuncts which may or may not be ionic in nature. When used in the aqueous liquid detergent matrices of the present invention, the semipermeable membrane permits the transfer of water or solvent between the liquid bead core and the aqueous liquid detergent composition matrix, by osmotic effect, until equilibrium is substantially reached. This contributes to the physical stability of the beads within the detergent composition matrix. Without being bound by theory, it is believed that when the bead-containing detergent composition is combined with fresh water to form a wash liquor, for example during a laundering operation, the resulting gradient of ionic strength between the resulting wash liquor and the bead core draws water into the core. This, in turn, exerts high pressure on the bead membrane which consequently disintegrates. This mechanism contributes to the disintegration of the beads in use and to the release into the wash liquor of the bead core material, including any laundry adjuncts, the bead may be carrying. This disintegration of the beads is generally independent of the wash water temperature. The beads will, in fact, disintegrate across the whole range of temperatures encountered during normal home laundering operations including, for example, low temperature washing conditions.

Detergent composition beads of the type utilized in this invention can, in general, be prepared by forming droplets or particles containing the requisite ionically charged polymeric material, and by thereafter contacting such droplets or particles with a liquid"curing bath" containing the requisite ionic polymeric material of opposite charge. This contact of droplets/particles with curing bath causes the interaction, e.g., reaction, of the two types of polymeric materials to occur, and this in turn forms the resulting osmotic membrane around each droplet or particle. Beads of this general type and prepared in this general way are frequently referred to as"microcapsules." Microcapsules of this type, and their preparation and use, are disclosed in greater detail in PCT Published Application Nos. WO 01/01927 and WO 02/055649. Especially preferred beads for use herein are the microcapsules described in detail, along with their preparation, in the commonly owned, concurrently filed patent applications of The Procter & Gamble Company, which are EPO Application No. EP03254825.7 (P&G Case CM-277 IF) and EPO Application No. EP03254826.5 (P&G Case CM-2772F).

The ionically charged polymeric materials used to form both the core and the membrane of the beads herein may be either cationically or anionically charged. Such materials are also referred to as"polyelectrolytes". Cationic and anionic polyelectrolytes must be capable of reacting with each other to form a complex which will function as the semipermeable membrane of the beads. Such polyelectrolyte materials may be either naturally occuring polymers or synthetic polymers. (For purposes of this invention, the term"polymers" includes oligomers.)

The core of the beads may comprise the anionic polyelectrolyte while the curing bath, e.g., curing solution, which reacts with this core to form the bead-encapsulating membrane may contain the cationic polyelectrolyte. Alternatively, it may be the other way around with the core comprising the cationic polyelectrolyte and the curing bath containing the anionic polyelectrolyte. Preferably, the anionic polyelectrolyte is in the core.

Suitable anionic natural polyelectrolytes may be selected from anionic gums. Suitable anionic gums include alginates, carrageenan, gellan gum, carboxyl methyl cellulose, xanthan gum and mixtures thereof. Suitable anionic synthetic polyelectrolytes may be selected from the group consisting of polyacrylates and polymethacrylates, polyvinyl sulphates, polystyrene sulphonates, polyphosphates and mixtures thereof.

Suitable cationic natural polyelectrolytes may be selected from the group consisting of chitosan, chitosan derivatives such as quaternarized chitosan and aminoalkylated and quaternarized celluloses and poly-L-lysine and mixtures thereof. Suitable cationic synthetic polyelectrolytes may be selected from the group consisting of poly-(N,N,N-trialkylammoniumalkyl) acrylates, poly-(N-alkylpyridinium) salts, polyethylenimines, aliphatic ionenes, poly-(diallyldialkylammonium) salts and mixtures thereof, wherein the alkyl is preferably short chain with from 1 to about 4 carbon atoms, preferably methyl.

Preferred for use herein as the core material for the beads are solutions of sodium alginate. Droplets of such solutions are preferably contacted with a curing bath which comprises poly-(diallyldimethylammonium) chloride, chitosan polymer (having a molecular weight of from about 10 to 1,000 kDa, preferably from about 50 to 500 kDa), chitosan oligomer (having a molecular weight of from about 300 to about 9,000 Da, preferably from about 500 to about 5,000 Da) or a mixture of these chitosan polymers and oligomers. These combinations of core solution and curing bath are preferred for the short reaction time and for the low permeability of the resulting beads, especially preferred being combinations of sodium alginate with poly-(diallyldimethylammonium) chloride.

Generally the volume of the curing bath is at least 10 times, preferably at least 100 times and more preferably at least 1,000 times larger than that of a bead-forming droplet. Therefore, the amount of the polyelectrolyte in the curing bath is generally well in excess over that of the polyelectrolyte in the bead core liquid. Thus the concentration of the polyelectrolyte in the curing bath is not very critical. Generally the concentration of the polyelectrolyte in the curing bath can range from 0.5% to 5%, more preferably from 0.8% to 2%, by weight of the curing bath.

Preferably the pH of the curing bath is determined by the pH at which the curing bath polyelectrolyte will dissolve. The residence time of the droplets in the curing bath can be adjusted according to the desired thickness of the bead membrane. Generally the membrane-forming reaction in the curing bath will take place with the curing bath maintained under agitation conditions.

Preferably the curing bath for the beads will comprise a mixture of chitosan polymer and chitosan oligomer, preferably in a weight ratio of from about 5:1 to about 1:1, more preferably from about 3:1 to about 1:3. Such a combination provides a bead membrane of both good strength and a very low membrane permeability.

The bead membrane which is formed by interaction of the polyelectrolyte in the bead core liquid with the polyelectrolyte in the curing bath is one which controls the osmotic absorption behavior of the bead. Generally such a membrane is a complex which completely encapsulates the core and all of the materials which the core holds. Although it can be difficult to determine where the membrane ends and the bead"core" begins, this membrane complex will generally have a thickness typical of osmotic membranes known in the art. At a minimum, such thickness can be molecular.

Membrane permeability is such that it allows the transfer of water or solvent between the aqueous matrix of the liquid detergent which holds the beads and the cores of the beads. The membrane, however, precludes the leaching out of many of the actives which can be held within the bead core.

When the beads encounter aqueous media having much lower concentrations of ionic species than in the aqueous liquid detergent matrix, such as when the beads are introduced into an aqueous washing liquor, water from the liquor is transported through the membrane and into the bead core until the bead disintegrates under the aqueous washing conditions it encounters.

The core liquid used to form the beads will preferably have a viscosity, measured at 25° C. and a shear rate of 1 $sec^{-1}$ ranging from 0.5 to 1000 Pa s., more preferably a viscosity of from 5 to 800 Pa s. Concentrations of polyelectrolyte ranging from 1% to 15%, more preferably from 2% to 10%, most preferably from 3% to 8%, by weight of the core liquid, will generally provide core liquids of the requisite viscosity.

The core liquid used to form the beads may contain, in addition to the required polyelectrolyte and water, a wide variety of additional materials. Such additional materials useful in bead formation include density modifiers; ionic strength modifiers; laundry adjuncts of the type essentially included in the laundry detergent compositions herein; detergent composition adjuncts optionally included in the detergent compositions herein; membrane permeability regulators; as well as solvents, dispersants and emuslfiers suitable for dissolving, emulsifying or dispersing all of the components of the bead core liquid into a homogenous fluid.

Preferably the core of the beads used in this invention includes a density modifier in a level such as to reduce the density of the resulting beads by at least about 10%, more preferably at least about 15% at 25° C. The density modifier helps to form beads of predetermined density which can then be suitably suspended in the structured aqueous liquid matrix of the detergent compositions herein. Such density reduction is evaluated by comparing two similar beads, the first one made from a liquid containing a given level of density modifier and the second one from a liquid wherein the density modifier has been substituted by the same weight of water.

Density modifiers are substances preferably having a density of less than about 1000 $Kg/m^3$, more preferably less than about 990 $Kg/M^3$ and higher than about 700 $Kg/m^3$, most preferably higher than about 800 $Kg/m^3$. Suitable density modifiers include hydrophobic materials and materials having a molecular weight higher than about 3,000, preferably higher than about 6,000, more preferably higher than about 10,000. Preferably the density modifier is insoluble but dispersible either with or without the aid of a dispersant agent, in water. Active detergent adjunct materials can play the role of density modifiers if they fulfill the aforementioned requirements.

Preferred density modifiers for use in the bead core liquids herein include silicone oils, corn oil, sunflower oil, rapeseed oil or any of the other readily available, relatively low cost vegetable oils, petrolatums and low density hydrophobic solvents such as limonene. They are frequently used in amounts which are sufficient to provide beads having densities within the ranges set forth hereinafter for bead density. Typically such density modifier concentrations will range from 5% to 50%, more preferably from 10% to 30% by weight of the core liquid.

The bead core liquid may also comprise various types of essential and/or optional detergent composition active materials. Such materials include those which are hydrophobic, e.g., perfume oils, silicone fluids, surfactants with an HLB below 10, etc. For purposes of this invention a material is "hydrophobic" if it has an octanol water partition coefficient, expressed as its log to the base 10 or "ClogP" (See GB Patent No. 2,311,296), of greater than 1.

The bead core liquid may also comprise high molecular weight (greater than 12,000) hydrophilic materials such as enzymes. Such materials can be included in the bead core solution and will then eventually be held within and protected by the membrane-encapsulated beads. Such materials do not readily pass through the bead membrane and will thus be held within the bead core until the beads disintegrate within the aqueous washing liquor.

The bead core liquid may also contain membrane permeability regulators. These are materials which serve to decrease the permeability of the membranes which eventually form around the bead core liquid when droplets/particles thereof are contacted with the curing bath. When such permeability regulators are included in the bead core liquid , preferably in concentrations ranging from 0.05% to 5% by weight of the core liquid , then it may be possible for hydrophilic detergent composition active materials having molecular weights as low as 10,200 or even as low as 3,000 to be incorporated into and held within the bead cores.

One type of useful membrane permeability regulator which can be included in the bead core liquid comprises nanoparticulate or microparticulate material having particle sizes ranging from 1 nm to 10,000 nm, more preferably from 50 nm to 5,000 nm. Nanoparticulate or microparticulate membrane permeability regulators can include materials such as $TiO_2$ which can also serve as a pigment to color or alter the optical properties of the eventually resulting beads. Other suitable types of nanoparticulate or microparticulate membrane permeability regulators include particles of polyacrylate or other polymeric materials within the size range specified.

The bead core liquid can also comprise a dispersant or emulsifier, especially if any of the other components of the core solution are hydrophobic materials or insoluble nanoparticles or microparticles, in order to facilitate the suspension or emulsification process. Preferred dispersants for use in the bead core liquid include polymers, especially polyvinyl alcohol. Preferred emulsifiers for use in the bead core liquid comprise surfactants. Dispersants and/or emulsifiers are usually used in low levels, suitable levels for use herein being from about 0.1 to about 5%, preferably from about 0.2 to about 3%, by weight of the bead core liquid.

The droplets or particles of the bead core liquid, which are added to the curing solution or bath to complete bead formation, are preferably formed by passing such a liquid through one or more nozzles or orifices to form a coherent, preferably laminar-flowing, fluid stream. That fluid stream can then be "cut" into separate droplets/particles by mechanically passing a shearing force through the stream at intervals, preferably regular intervals, along the length of the fluid stream. That shearing force can be provided by a mechanical element such as a knife or rotating wire or can be provided by the shearing action of a cutting fluid such as water or air jet.

The fluid, preferably laminar-flowing, stream into which the bead core liquid is formed can result from simple gravity flow of such a liquid through one or more orifices. More preferably, however, the bead core liquid will be forced through one or more orifices or nozzles by applying pressure to the bulk fluid on one side of the orifices or nozzles. Such pressure application can thus be used to form "jets" of laminar-flowing fluid streams which can be more readily "cut" into droplets or particles of controlled and relatively regular size and configuration. Such fluid steams can, of course, be of any geometric configuration depending on the shape and size of the nozzles or orifices which the fluid flows through and further depending on the extruding pressure used and the rheology of the core liquid .

Most conventionally, the fluid jet stream(s) will be generally cylindrical and the cutting of such fluid jet streams will form, immediately after cutting, droplets or particles in the form of cylindrical segments. As these cylindrical segments fall toward the curing bath into which they are to be dropped, they generally form themselves into substantially spherical droplets due to surface tension effects.

Devices suitable for forming and cutting fluid jets are known in the art and are suitable for forming the beads used in the detergent compositions herein. One such device is available from GeniaLab and is sold under the tradename, Jet Cutter®. Methods and devices for forming beads using the jet-cutter technology are described in greater detail in DE 44 24 998 and in PCT Patent Publication No. WO 00/48722.

In preferred embodiments using the Jet Cutter® device, the fluid jet stream of the first solution is formed by passing the solution through a nozzle having a diameter of from 0.2 mm to 8 mm, more preferably from 0.5 mm to 4 mm, using a through-put rate of from 0.5 g/s to 20 g/s, more preferably from 1 g/s to 6 g/s. The fluid jet steam is preferably cut by mechanical means, especially preferred being rotating cutting wires having a diameter of from 10 μm to 1,000 μm, more preferably from 50 μm to 500 μm, and having a cutting speed of from 500 rpm to 10,000 rpm, more preferably from 1,000 rpm to 6,000 rpm.

The bead-forming process is preferably carried out at ambient temperature, this being advantageous when dealing with heat sensitive core liquid materials such as perfumes and enzymes. However, if non-heat sensitive materials are to be encapsulated within the beads, the core liquids of the process can be heated in order to speed the kinetics of the complexation reaction within the curing bath.

The beads which are useful herein, and which can be prepared in the manner hereinbefore described, will preferably have a number of characterizing parameters which make them especially useful in the liquid laundry detergent compositions herein. Such parameters can be summarized as follows: (Methods, procedures and equipment useful for determining the values of the various bead and bead-making parameters are also described and summarized hereinafter.)

Bead Size/Shape

The beads useful in this invention will preferably be substantially spherical in shape. They will generally have a diameter (or effective diameter which is the diameter of a sphere of the same mass as a non-spherical bead) in the range from 0.2 to 8 mm, preferably from 0.3 mm to 3 mm and more preferably from 0.5 to 4 mm. These ranges are preferred from the standpoint that the beads can be visualized with the naked eye and from ease of manufacture.

Bead Density

The beads useful herein will preferably have a density of from 900 to 1,300 $Kg/m^3$, more preferably from 950 to 1,200 $Kg/m^3$ and most preferably from 980 to 1,100 $Kg/m^3$ at 25° C. As indicated hereinbefore, bead density, along with the rheology of the aqueous liquid matrix of the detergent composition, are interrelated with respect to the ability of the beads to be stably suspended within the liquid detergent compositions. In preferred embodiments of the compositions herein, the difference between the density of the aqueous liquid matrix and the density of the beads is less than 10%, more preferably less than 5% and even more preferably less than 3% at 25° C. This contributes to the suspension stability of the beads within the liquid detergent compositions and permits the use of less of the external structuring agent than might otherwise be required for stable bead suspension.

Preferably the beads are suspended so that the liquid detergent compositions are stable for 4 weeks at 25° C. Stability can be evaluated by direct observation or by image analysis, by having colored beads suspended in a transparent liquid contained in a transparent bottle. A detergent composition freshly made is considered to be stable if less than 10%, preferably less than 5%, and more preferably less than 1% by weight of the beads settle to the bottom of the bottle after 4 weeks static storage.

Bead Burst Stength

Beads suitable for use in the liquid detergents herein should be physically and chemically compatible with the detergent matrix ingredients, but they should disintegrate in use without leaving residues on fabrics and garments being laundered. Thus within the aqueous liquid matrix of the detergent compositions, the beads are preferably capable of withstanding a force before bursting of from 20 mN to 20,000 mN, more preferably from 50 mN to 15,000 mN and most preferably from 100 mN to 10,000 mN. This strength makes them suitable for industrial handling, including liquid detergent making processes. They can also withstand pumping and mixing operations without significant breakage and are also stable on transport. At the same time, the beads herein disintegrate readily in use by virtue of their osmotic behavior in dilute aqueous media such as agitated washing liquors.

Bead and Bead Making Testing Procedures

The viscosity of the bead core liquid used in bead preparation can be measured using a Physica USD200 controlled stress cup and bob rheometer (Z3–25 mm). A shear rate curve is generated at 25° C. Thirty measurement points of 10 seconds duration are taken between a shear rate of 0.1 $s^{-1}$ and 100 $s^{-1}$. From this experimental curve, the viscosity at 1 $sec^{-1}$ can be extrapolated.

The size and shape of the beads used herein can be characterized using an optical microscope (Leica MZ8) and image analysis system (Leica Q500MC, Quips, UK). Before running the analysis, the beads are taken from a 0.9% sodium chloride solution and placed on the microscope table. During the measurement, the beads are kept wet using a 0.9% sodium chloride solution. Prior to processing of the images, it should be checked to insure that all beads are detected as single entities. The equivalent circle diameter is the diameter of a circle of an equivalent cross sectional area to that of the particle.

The density of the beads herein can be measured using a Helium Pycnometer (Micromeritics AccuPyc 1330) at 21° C. and 25 psi (1760 g/cm2). A bead is taken from a 0.9% sodium chloride storage solution and gently patted with paper tissue to remove excess liquid before the measurement is taken. The force before bursting that a bead can withstand can be measured by using a Dynamic Mechanical Analyzer (Perkin Elmer DMA 7e). A single bead is separated from the storage liquid (0.9% NaCl) and placed on the parallel sample plate of the analyzer. The bead is covered with a drop of a 0.9% sodium chloride solution. To establish the force at the bursting point, a static strain scan is performed applying an increasing force of 20 mN/minute during the bead compression. The imposed force and the displacement of the squeezed bead are automatically recorded. The point of bursting corresponds to the first shoulder on the static force scan curve and in particular the intersection point of the two tangents constructed as a best fit to the upper and lower lateral portions of the shoulder.

Water

The aqueous liquid laundry detergent compositions of the present invention will, of course, contain significant amounts of water in order to form the structured aqueous liquid matrix thereof. Water will generally comprise from 30% to 75%, preferably from 35% to 72%, more preferably from 40% to 70% by weight of the compositions herein.

Other Optional Composition Components

In addition to the essentially present laundry adjuncts described hereinbefore, the aqueous liquid laundry detergents herein can optionally contain a wide variety of additional ancillary detergent composition/washing adjuncts. Such optionally utilized detergent composition adjuncts may be dissolved or suspended within the aqueous liquid matrix of the compositions herein. Alternatively, as noted hereinbefore, such optional materials may also be incorporated into the core of the visible beads used herein. Preferably such bead-incorporated materials are completely encapsulated within the beads so that they are not released from the beads until the beads disintegrate in the wash liquor during laundering operations.

Such optionally added ancillary adjuncts comprise those conventionally employed in detergent compositions. They include stabilizers, ancillary detersive surfactants, detersive builders, solvents, perfumes, coloring agents and combinations of such ancillary washing ingredients.

Stabilizers serve to maintain the chemical and/or physical integrity of the liquid compositions herein or one or more components thereof (e.g., enzymes). Examples of such stabilizers include NaOH, aryl sulfonates, boric acid and the like.

Ancillary detersive surfactants can include those other than the anionic and/or nonionic surfactants essentially present. Such ancillary surfactants can be of the cationic, amphoteric and/or zwitterionic types.

Detersive builders help improve the cleaning performance of the compositions herein and can include any of the sequestering, chelating or precipitating types. Examples of such builders include $C_{12-18}$ fatty acids and soaps and alkali metal citrates.

Solvents, like stabilizers, can help prevent undesirable or unwanted phase separation of the liquid compositions herein. Suitable solvents include such non-aqueous liquids as $C_{1-4}$ alkanols, $C_{4-8}$ alkylene glycols, and $C_{1-18}$ esters and ethers.

Perfumes can improve the aesthetics of the liquid detergent products themselves. Perfumes can also impart desirable odor chracteristics and/or malodor control to fabrics being laundered using the detergent compositions herein.

Coloring agents also serve to impart desirable aesthetic characteristics to the liquid detergent compositions and can include dyes, pigments, opacifiers, etc. Dyes may be soluble in the aqueous liquid matrix and can include Ultramarine Blue dye, Acid 80 Blue dye, Red HP Liquitint, Blue Liquitint and the like. Pigments such as titanium dioxide may be insoluble and may be suspended in the aqueous liquid matrix. Furthermore, pigments may be incorporated into the beads within the aqueous liquid matrix to impart color or opacity to the beads.

While a wide variety of optional detergent composition or washing adjuncts may be employed in the compositions herein, the compositions should contain no matrials which interact with, soften or destroy the osmotic membrane which encapsulates the beads within the composition. For example, lower molecular weight amino-functional materials such as alkanolamines are preferaby not present in the compositions herein or at least not used in excess of the amount which serves to neutralize any acidic components of the compositions.

The various optional washing adjuncts, if present in the compositions herein, should be utilized at concentrations conventionally employed to bring about their desired contribution to the composition or the laundering operation. Frequently, the total amount of such optional washing adjuncts can range from 0.1% to 40%, more preferably from 1% to 30%, by weight of the compositions herein.

Composition Preparation

The aqueous liquid detergent compositions herein can generally be prepared by first forming a pre-mix within which the organic external structurant is dispersed in a portion of the water eventually used to comprise the aqueous liquid matrix of the compositions herein. This pre-mix is formed in such a way that it comprises a structured aqueous liquid.

To this structured pre-mix can then be added, while the pre-mix is under agitation, the surfactant(s) and essential laundry adjunct materials, along with water and whatever optional detergent composition adjuncts are to be used. Any convenient order of addition of these materials, or for that matter, simultaneous addition of these composition components, to the pre-mix can be carried out. The resulting combination of structured premix with the balance of the composition components forms the aqueous liquid matrix to which the essential visibly distinct beads will be added.

In a particularly preferred embodiment wherein a crystalline, hydroyxl-containing structurant is utilized, the following steps can be used to activate the structurant:

1)A premix is formed by combining the crystalline, hydroxyl-stabilizing agent, preferably in an amount of from about 0.1% to about 5% by weight of the premix, with water which comprises at least 20% by weight of the premix, and one or more of the surfactants to be used in the composition, and optionally, any salts which are to be included in the detergent composition.

2) The pre-mix formed in Step 1) is heated to above the melting point of the crystalline, hydroxyl-containing structurant.

3)The heated pre-mix formed in Step 2) is cooled, while agitating the mixture, to ambient temperature such that a thread-like structuring system is formed within this mixture.

4)The rest of the detergent composition components, other than those which will form part of the visibly distinct beads, are separately mixed in any order along with the balance of the water, to thereby form a separate mix.

5)The structured pre-mix from Step 3 and the separate mix from Step 4 are then combined under agitation to form the structured aqueous liquid matrix into which the visibly distinct beads will be incorporated.

The visibly distinct beads, prepared as decribed in detail hereinbefore, are then combined with the structured aqueous liquid matrix, prepared as described above, while maintaining the matrix under agitation to disperse the beads therein. The beads can be added as dried beads which have been recovered from the curing solution bath in which they were formed. Alternatively, the beads can be added to the structured aqueous liquid matrix as a slurry of the beads maintained in an aqueous salt solution containing, for example, about 0.9% by weight of dissolved NaCl. The slurry of beads may itself be structured with an external structurant of the type described herein.

Composition Use

The compositions of this invention, prepared as hereinbefore described, can be used to form aqueous washing solutions for use in the laundering of fabrics. Generally, an effective amount of such compositions is added to water, preferably in a conventional fabric laundering automatic washing machine, to form such aqueous laundering solutions. The aqueous washing solution so formed is then contacted, preferably under agitation, with the fabrics to be laundered therewith.

An effective amount of the liquid detergent compositions herein added to water to form aqueous laundering solutions can comprise amounts sufficient to form from about 500 to 7,000 ppm of composition in aqueous wash liquor. More preferably, from about 800 to 3,000 ppm of the detergent compositions herein will be provided in aqueous washing liquor.

The following examples illustrate the preparation of the bead-containing, aqueous liquid detergent compositions of the instant invention.

EXAMPLE I

Preparation of a Structured Liquid Detergent Matrix

A structured liquid detergent matrix is prepared by combining an aqueous premix of conventional heavy duty liquid (HDL) detergent composition components with a structuring agent premix. Each of these two premixes is prepared as follows:

The HDL components premix is prepared by combining HDL components with water in a suitable vessel under suitable agitation. The resulting premix has the composition shown in Table I.

TABLE I

HDL Components Premix

| Component | Concentration (Wt %) |
|---|---|
| $C_{12}$LAS | 7.5 |
| $C_{14-15}E0_8$ Alcohol Ethoxylate | 5.7 |
| $C_{12-14}$Amine Oxide | 1.0 |
| Citric Acid | 2.0 |
| $C_{12-18}$ Fatty Acid | 5.2 |
| Enzymes (Protease, Amylase, Mannanase) | 0.6 |
| MEA-Borate | 1.5 |
| DTPMP[1] Chelant | 0.2 |
| Ethoxylated Polyamine Dispersants | 1.2 |
| Silicone/Silica Suds Suppressor | 0.002 |
| Ethanol | 1.4 |
| Propane Diol | 5.0 |
| NaOH | 3.1 |
| Perfume, Brightner, Hydrotrope, Colorant, Other Minors | 4.2 |
| Water | Balance to 96.5%[2] |

[1]Sodium diethylene triamine penta (methyl phosphonate)
[2]To allow for later addition of structurant pre-mix and beads The structuring agent premix is prepared by combining hydrogenated castor oil and the other structuring agent premix ingredients shown in Table II with water under certain conditions. In particular, the Table II components except for the hydrogenated castor oil are combined and the resulting mixture is heated to 90° C. The hydrogenated castor oil is then added and the mixture is maintained under agitation until all of the hydrogenated castor oil has been emulsified. After full emulsification, the mixture is flash cooled to 70° C. and left at this temperature until all of the hydrogenated castor oil is recrystallized. At this point the structuring agent premix is allowed to cool down slowly to ambient temperature. The resulting structuring agent premix has the composition shown in Table II.

TABLE II

Structuring Agent Premix

| Component | Concentration (Wt %) |
|---|---|
| Hydrogenated Castor Oil | 4.0 |
| $C_{12}$HLAS | 16.0 |
| Sodium Metaborate | 1.5 |
| NaOH | 3.5 |
| Water | Balance to 100% |

As a next step, 2.5 parts of the structuring agent premix of Table II are added slowly to 96.5 parts of the HDL components premix of Table I under slow agitation. The resulting composition is the aqueous liquid matrix of an HDL product of this invention. This matrix has the following Theological characteristics:

Pouring Viscosity=170 cps

Viscosity at Constant Low Stress of 0.1 Pa=687,000 cps

Ratio of Pouring Viscosity to Viscosity at Constant Stress=4,041.

EXAMPLE II

Preparation of Beads for Addition to the Structured Aqueous Liquid Matrix

Beads for incorporation into an aqueous liquid laundry detergent composition of this invention are prepared using the following procedure:

Approximately 160 grams of polyvinyl alcohol (PVA), Mowiol 3-83 ex Clariant are dispersed into 14,406 grams of de-ionized water and dissolved at 60° C. Approximately 760 grams of sodium alginate from brown algae (ex Fluka product code 71238) are added to the PVA solution and mixed. Approximately 4,600 grams of polydimethyl siloxane (PDMS), Dow Corning 200 fluid 100,000 cSt ex Dow Corning are mixed with the alginate/PVA mixture to form a high viscosity (70 Pas at 25° C. at a shear rate of 1 $s^{-1}$) solution. This is the core solution of beads to be formed.

As a next step, this core solution is formed into droplets using a JetCutter particle generator machine ex GeniaLab. To accomplish this, the above solution is extruded in the JetCutter at throughput of 4.87 g/s through a 1.0 mm nozzle and cut using a rotational cutting tool containing 24 wires of 200 micron thickness with a cutting speed of 3150 rpm to form spherical droplets with a diameter between 1000 and 1500 microns using the mechanical cutting device of the JetCutter. These droplets are allowed to fall into an agitated hardening bath that contains 10 liters of a 1% chitosan solution (Chitoclear ex Primex) brought to pH 2.5 with HCl.

After a hardening time in the hardening bath of 15 minutes, the droplets which have hardened into beads are separated from the chitosan solution via filtration, washed quickly with de-ionized water and stored in a 0.9 NaCl solution. The density of the beads so prepared is 1,038 $Kg/m^3$. The beads have an average particle size of about 800 microns.

EXAMPLE III

Preparation of Bead-Containing Aqueous Liquid Detergent Composition

The beads which are formed in accordance with the procedure of Example II are combined with the structured aqueous liquid detergent composition matrix prepared in accordance with Example I. This is accomplished by slowly adding the beads to the structured liquid matrix while it is maintained under gentle agitation. Enough beads are added to constitute 1% by weight of the composition which is formed. The resulting heavy duty liquid laundry detergent product has the composition shown in Table III.

TABLE III

Bead-Containing Liquid Laundry Detergent

| Component | Concentration (Wt %) |
|---|---|
| $C_{12}$LAS | 7.9 |
| $C_{14-15}E0_8$ Alcohol Ethoxylate | 5.7 |
| $C_{12-14}$Amine Oxide | 1.0 |
| Citric Acid | 2.0 |
| $C_{12-18}$ Fatty Acid | 5.2 |
| Enzymes (Protease, Amylase, Mannanase) | 0.6 |
| MEA-Borate | 1.5 |
| DTPMP[1] Chelant | 0.2 |
| Ethoxylated Polyamine Dispersants | 1.2 |
| Silicone/Silica Suds Suppressor | 0.002 |
| Ethanol | 1.4 |
| Propane Diol | 5.0 |
| NaOH | 3.2 |
| Hydrogenated Castor Oil | 0.1 |
| Beads from Example II | 1.0 |
| Perfume, Brightner, Hydrotrope, Colorant, Other Minors | 4.2 |
| Water | Balance to 100% |

The heavy duty liquid laundry detergent composition of Table III is in the form of an aqueous liquid matrix having visibly distinct beads substantially uniformly dispersed throughout. The product is physically and chemically stable. The beads therein do not substantially settle out over prolonged periods of shipping and storgage of the product.

This liquid detergent product can be easily dispensed from its container into the drum of an automatic washing machine wherein an aqueous washing liquor containing approximately 1500 ppm of the detergent composition is formed. When fabrics, and even dark fabrics, are washed in conventional manner using such an aqueous washing liquor, and when such fabrics are thereafter rinsed and dried, no visible residues from the beads of the detergent product remain on the laundered fabrics.

What is claimed is:

1. A heavy-duty liquid detergent composition in the form of an externally-structured, aqueous liquid matrix having dispersed therein a plurality of visibly distinct beads, which composition comprises:

A) from about 5% to 50% by weight of said composition of a detersive surfactant selected from anionic surfactants, nonionic surfactants, and combinations thereof;

B) from about 0.1% to 30% by weight of a laundry washing adjunct selected from detersive enzymes, optical brighteners, dye transfer inhibition agents, suds suppressors, detersive soil realease polymers, other fabric care benefit agents, and combinations of said laundry washing adjuncts;

C) from about 0.01% to 1% by weight of an organic external structurant selected from the group consisting of i) non-polymeric crystalline, hydroxy-functional materials which form thread-like structuring systems throughout the aqueous liquid matrix of said composition upon in situ crystallization therein;

ii) polymeric structurants selected from polyacrylates, polymeric gums, other non-gum polysaccharides, and combinations thereof, said polymeric structurants imparting shear thinning characteristics to the aqueous liquid matrix of said composition;

iii) any other structurant which imparts to the aqueous liquid matrix of said liquid composition a pouring viscosity at 20 $sec^{-1}$ of from about 100 cps to 2500 cps; a viscosity at constant low stress of 0.1 Pa which is at least about 1500 cps, and a ratio of said constant low stress viscosity to said pouring viscosity of at least about 2; and iv) combinations of said external structurant types;

D) from about 0.01% to 5% by weight of visibly distinct beads, each of said beads comprising a cationic or anionic polymeric component and a semipermeable membrane formed by interaction of said cationic or anionic polymeric component with an anionic or cationic polymeric material of opposite charge, said membrane serving to impart osmotic permeability characteristics to said beads such that said beads maintain their structural integrity within the aqueous liquid matrix of said composition but disintegrate without leaving visible residues as a consequence of osmotic water permeability upon aqueous dilution of said composition during washing operations; and E) from about 30% to 75% by weight of water.

2. A composition according to claim 1 which additionally comprises from about 0.1% to 40% by weight of an ancillary detergent composition adjunct selected from stabilizers, detersive ancillary surfactants and builders, solvents, perfumes, dyes and combinations of such ancillary washing ingredients.

3. A composition according to claim 2 wherein said beads are stably suspended within said aqueous liquid matrix by means of adjustment of bead density, matrix rheology or both.

4. A composition according to claim 2 wherein at least one of said laundry washing adjuncts or said ancillary detergent compostion adjuncts is incorporated within said beads and is completely coated with said semi-permeable membrane.

5. A composition according to claim 1 wherein said beads are formed from an anionic polymeric material surrounded by a semi-permeable membrane formed by reacting said anionic polymeric material with a cationic polymeric material.

6. A composition according to claim 1 wherein said beads are formed from a cationic polymeric material surrounded by a semi-permeable membrane formed by reacting said cationic polymeric material with an anionic polymeric material.

7. A composition according to claim 1 wherein said beads are prepared by a process which comprises mechanical or air-assisted cutting of a fluid jet stream formed from a bead core liquid containing one of said anionic or cationic bead polymeric components, to thereby form droplets which are subsequently cured in a curing bath containing the oppositely charged polymeric material.

8. A composition according to claim 7 wherein said beads have an average diameter ranging from about 0.2 to 8 millimeters.

9. A composition according to claim 8 wherein said beads have an average burst strength of from about 20 mN to 20,000 mN.

10. A composition according to claim 7 wherein the anionic polymeric component of said beads comprises an alginate and the cationic polymeric component of said beads comprises chitosan or a chitosan derivative.

11. A composition according to claim 7 wherein said cationic polymer comprises a synthetic material selected from poly-(N,N,N-trialkylammoniumalkyl) acrylates, poly-(N-alkylpyridinium) salts, polyethylenimines, aliphatic ionenes, poly-(diallyldialkylammonium) salts and mixtures thereof; wherein the alkyl is short chain with from 1 to 4 carbon atoms.

12. A composition according to claim 1 wherein the C(i) external structurant component comprises one or more compounds of the formulas:

$R^1OCH_2CH(OR^2)CH_2OR^3$ or i)

$R^5C(O)—OM$; or ii)

mixtures thereof iii)

wherein, in these formulas, $R^1$ is $—C(O)R^4$;

$R^2$ is $R^1$ or H;

$R^3$ is $R^1$ or H;

$R^4$ is independently $C_{10-22}$ alkyl or alkenyl comprising at least one hydroxyl;

$R^5$ is $—C(O)—R^4$; and

M is $Na^+$, $K^+$, $Mg^{++}$, $Al^{3+}$, or H.

13. A composition according to claim 12 wherein said composition is structured by in-situ crystallization of an external structurant of the formula:

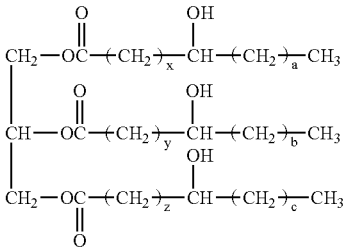

wherein:

(x+a) is from between 11 and 17; (y+b) is from between 11 and 17; and (z+c) is from between 11 and 17.

14. A composition according to claim 1 wherein the external structurant C(ii) component is selected from gellan gum, guar gum, xanthan gum, gum arabic and combinations thereof.

15. A composition according to claim 13 wherein the external structurant is selected from crystalline, hydrogenated castor oil or a crystalline, hydrogenated castor oil derivative.

16. A composition according to claim 1 which comprises:

a) from about 8% to 40% by weight of said detersive surfactant component;

b) from about 0.5% to 20% by weight of said laundry washing adjunct component;

c) from about 0.05% to 0.75% by weight of said external structurant;

d) from about 0.05% to 4% by weight of said beads;

e) from about 35% to 72% by weight of water; and f) from about 1% to 30% by weight of an ancillary washing adjunct selected from stabilizers, detersive ancillary surfactants and builders, solvents, perfumes, dyes, and combinations of such ancillary washing adjuncts.

17. A composition according to any of claims 1 to 16 which is substantially free of any low molecular weight, bead-softening amino-functional compounds.

18. A composition according to claim 10 wherein said beads contain a nanoparticulate or microparticulate membrane permeability regulator which is also a colorant.

19. A heavy-duty liquid detergent composition in the form of an externally-structured, aqueous liquid matrix having suspended therein a plurality of visually distinct beads, which composition comprises:

A) from about 10% to 35% by weight of a detersive surfactant selected from $C_{10-16}$ linear alkylbenzene sulfonates, $C_{8-20}$ alkyl polyethoxylate sulfates containing from about 1 to 20 moles of ethylene oxide, $C_{8-16}$ alcohol polyethoxylates containing from about 1 to 16 moles of ethylene oxide, and combinations of said surfactants;

B) from about 1% to 10% by weight of a laundry washing adjunct selected from detersive enzymes, optical brighteners, silicone-based fabric care agents, and combinations of said washing adjuncts;

C) from about 0.02% to 0.5% by weight of an external structurant for said aqueous liquid matrix, said structurant comprising a crystalline, hydrogenated castor oil or castor oil derivative;

D) from about 0.1% to 3% by weight of visibly distinct beads having an average diameter ranging from about 0.5 to 4 millimeters, each of said beads comprising an alginate core encapsulated with a semi-permeable membrane formed by contacting alginate from said core with a curing solution comprising chitosan;

E) from about 40% to 70% by weight of water; and

F) from about 1% to 30% by weight of an ancillary detergent composition adjunct selected from stabilizers, builders, solvents, perfumes, dyes or combinations of such ancillary washing ingredients.

20. A heavy-duty liquid detergent composition in the form of an externally-structured, aqueous liquid matrix having dispersed therein a plurality of visibly distinct beads, which composition comprises:

A) from about 5% to 50% by weight of said composition of a detersive surfactant selected from anionic surfactants, nonionic surfactants, and combinations thereof, B) from about 0.1% to 30% by weight of a laundry washing adjunct selected from detersive enzymes, optical brighteners, dye transfer inhibition agents, suds suppressors, detersive soil realease polymers, other fabric care benefit agents, and combinations of said laundry washing adjuncts;

C) from about 0.01% to 1% by weight of an organic external structurant which imparts to the aqueous liquid matrix of said liquid composition a pouring viscosity at 20 $sec^{-1}$ of from about 100 cps to 2500 cps; a viscosity at constant low stress of 0.1 Pa which is at least about 1500 cps, and a ratio of said constant low stress viscosity to said pouring viscosity of at least about 2; and D) from about 0.01% to 5% by weight of visibly distinct beads, each of said beads comprising a cationic or anionic polymeric component and a semipermeable membrane formed by interaction of said cationic or anionic polymeric component with an anionic or cationic polymeric material of opposite charge, said membrane serving to impart osmotic permeability characteristics to said beads such that said beads maintain their structural integrity within the aqueous liquid matrix of said composition but disintegrate without leaving visible residues as a consequence of osmotic water permeability upon aqueous dilution of said composition during washing operations; said beads being prepared by a process which comprises mechanical or air-assisted cutting of a fluid jet stream formed from a bead core liquid containing one of said anionic or cationic bead polymeric components, to thereby form droplets which are subsequently cured in a curing bath containing the oppositely charged polymeric material; and E) from about 30% to 75% by weight of water.

* * * * *